United States Patent [19]

Large

[11] 4,193,157

[45] Mar. 18, 1980

[54] BAG SPREADER

[76] Inventor: Helen F. Large, 25 A Center St., Rumson, N.J. 07760

[21] Appl. No.: 26,821

[22] Filed: Apr. 4, 1979

Related U.S. Application Data

[63] Continuation of Ser. No. 887,125, Mar. 16, 1978, abandoned.

[51] Int. Cl.[2] ..... B65B 67/12

[52] U.S. Cl. ..... 15/257.1

[58] Field of Search ..... 15/104.8, 257.1, 257.7, 15/257.8, 257.9; 141/108; 248/99, 100, 101; 294/19 R

[56] References Cited

U.S. PATENT DOCUMENTS

| | | | |
|---|---|---|---|
| 1,266,522 | 5/1918 | Oldham | 141/108 |
| 3,135,984 | 6/1964 | Henke | 15/257.1 |
| 3,697,030 | 10/1972 | Schultz | 15/257.1 |
| 3,754,785 | 8/1973 | Anderson | 294/19 R |
| 3,936,087 | 2/1976 | Alexander | 15/257.1 |
| 3,998,415 | 12/1976 | D'Antonio | 15/257.1 |

*Primary Examiner*—Edward J. McCarthy

*Attorney, Agent, or Firm*—Le Blanc, Nolan, Shur & Nies

[57] ABSTRACT

A bag spreader in the form of a relatively rigid plastic hoop temporarily inserted into the open mouth of a flexible plastic trash bag. The hoop includes integral, external spikes adapted to be driven into the ground through the bag. Leaves are then easily raked into the bag. An incline or guide may be provided to ease the raking of the leaves into the bag. A drawstring closure may be provided on the bag for later closing after the hoop has being removed, and the bag may further have a pair of holes for receiving the spikes of the hoop.

7 Claims, 5 Drawing Figures

BAG SPREADER

This is a continuation of application Ser. No. 887,125, filed Mar. 16, 1978, abandoned.

BACKGROUND OF THE INVENTION

The invention concerns bag spreaders generally and, more specifically, an uncomplicated device for holding open the mouth of a flexible plastic trash bag or the like as leaves or other debris are swept or gathered into the bag.

The advent of disposable plastic trash or leaf collection bags has greatly eased the annual leaf gathering burden of the suburbanite. Such bags are usually strong, extremely lightweight and thus can hold a considerable quantity of raked leaves.

A major problem with these bags is that they are very difficult to hold open as one attempts to rake or sweep the gathered leaves into the bag. Ordinarily, one either finds a companion who holds the bag open so that leaves may be swept within, or he tries to hold the bag at least partially open with one hand while attempting with the free hand to manipulate the leaves into the bag. Of course, success eventually comes but not without considerable difficulty.

The prior art is replete with ideas on devices for holding open the mouth of such a bag and simultaneously orienting the bag mouth vertically so that the leaves and other debris may be swept into the bag. Some of these devices are unduly complicated while others are rather unwieldly. U.S. Pat. No. 3,697,030 issued to P. D. Schultz discloses a wire frame arrangement with ground engaging spikes and a pair of clothespins to retain the trash bag on the frame. A similar spiked frame and clothespin assembly is shown in U.S. Pat. No. 3,998,415 issued to J. V. D'Antonio et al. Another but more complex spiked frame having pairs of jaws to grip portion of the bag to keep it open is illustrated in the U.S. patent to A. Miller, U.S. Pat. No. 3,744,081 while another wire frame support having a portion extended into the main body of the bag is disclosed in U.S. Pat. No. 4,006,928 issued to L. E. Beugin. U.S. Pat. No. 4,023,842 shows a bag spreader in the form of an incomplete, rectangular frame employing the resiliency of the frame to spread the bag open and keep it open as debris is gathered into the bag.

What the prior art discussed above fails to disclose is a simple bag spreader in the form of an uncomplicated hoop for stretching and retaining the bag as debris is swept or gathered into the bag, the hoop having a spike or spikes for orienting the open mouth of the bag upright on the ground, with or without the further assistance of a ramp for guiding debris into the bag; a conventional or drawstring closure bag may be used.

SUMMARY OF THE INVENTION

Accordingly, it is a principal object of the invention to provide a spreader for holding open the mouth of a flexible bag, the spreader being in the form of a hoop having one or more spikes for orienting the hoop upright on the ground.

It is another object of the invention to provide a circular hoop bag spreader for holding open the mouth of a bag as trash or leaves are swept thereinto, and a ramp which may be snap-fit into the hoop when desired to further facilitate gathering of debris into the bag.

It is a further object of the invention to provide a circular hoop for holding open the mouth of a flexible bag to facilitate gathering of debris into the bag, a spike or spikes being provided on the hoop to orient the hoop upright on the ground, the bag having a drawstring closure for use after the bag is full and the hoop removed and one or more openings near the mouth of the bag through which the spike or spikes may be fitted.

It is yet another object of the invention to provide one-piece bag spreader of uncomplicated structure having no moving or adjustable parts and which is low in cost of manufacture.

Further novel features and other objects of this invention will become apparent from the following detailed description, discussion and the appended claims taken in conjunction with the accompanying drawings.

BRIEF DESCRIPTION OF THE DRAWINGS

Preferred structural embodiments of this invention are disclosed in the accompanying drawings in which.

DESCRIPTION OF THE PREFERRED EMBODIMENTS

Figure 1:
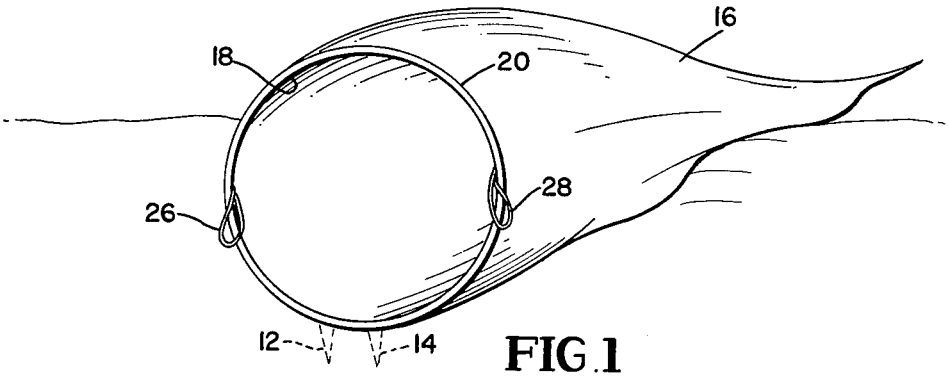
FIG. 1 is a perspective view of an embodiment of the invention including a bag spreading hoop and a drawstring closure bag spread open by the hoop.

A simple, one-piece self-sustaining relatively rigid stiff hoop 10 may be made of vinyl plastic or other suitable plastic material. Hoop 10 may be made from metal but less expensive, non-corrosive plastic is preferred. A pair of external projecting ground engaging spikes 12, 14 are provided, which may be integrally formed with hoop 10 or otherwise suitably attached. Spikes 12, 14 are preferably arranged in close, adjacent fashion so that, to orient the hoop vertically at the ground as shown in FIG. 1, all one has to do is place a foot internally of the hoop 10, directly over spikes 12, 14 and press the same into the ground. While two spikes are preferred for purposes of stability, a single spike could be used.

Figure 2:
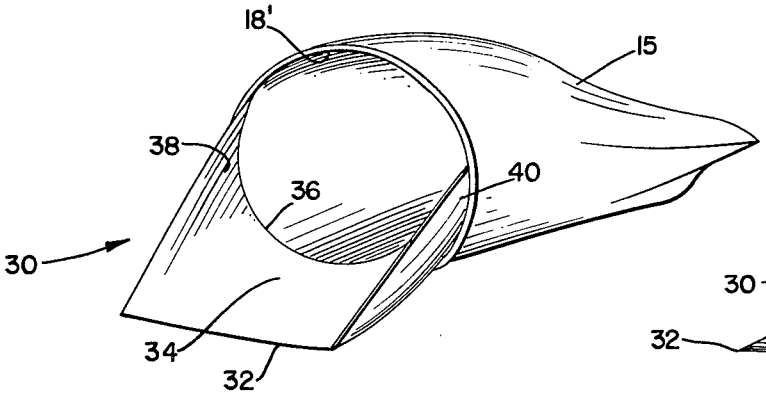
FIG. 2 is a view similar to FIG. 1 but further illustrating a ramp for guiding leaves and debris into the bag.

While an ordinary, readily available flexible plastic trash bag 15 (FIG. 2) might be used it is preferred to provide a plastic bag 16 which has an open mouth 18 sized to fit with hoop 10 and a drawstring closure 20. (The conventional bag 15 shown in FIG. 2 also has an open mouth 18' but no drawstring closure.) Additionally, a pair of sidewall openings 22, 24 are provided. Thus, bag 16 may be placed onto hoop 10 with spikes 12, 14 fitted through mating openings 22, 24 in the bag 16. Then hoop 10 may be oriented on the ground by pressing spikes 12, 14 into the ground with one's foot over the area of the hoop 10 above spikes 12, 14 as previously explained. Thereafter, leaves and other debris may be easily and conveniently gathered or swept into bag 16 by means of a rake (not shown) or by hand.

When bag 16 is full, a gentle pull at the upper side of hoop 10 opposite spikes 12, 14 will release the hoop and bag from the ground. Thereafter, the full bag may be placed on its closed end on the ground and hoop 10 removed from the bag. Bag 16 is now closed by drawstring closure 20 or if a standard bag 15 is used, it may be closed by a twist tie (not shown) or whatever other closure may be provided with bag 15. A new bag may now be placed on hoop 10 whereupon the leaf gathering process is repeated as often as desired using the same hoop.

Figure 3:
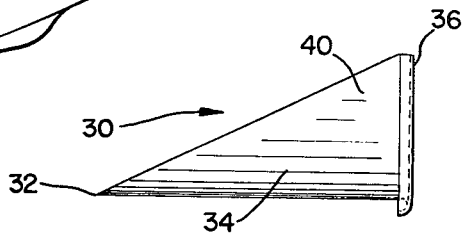
FIG. 3 is a side elevation view of the ramp disclosed in FIG. 2.
Figure 4:
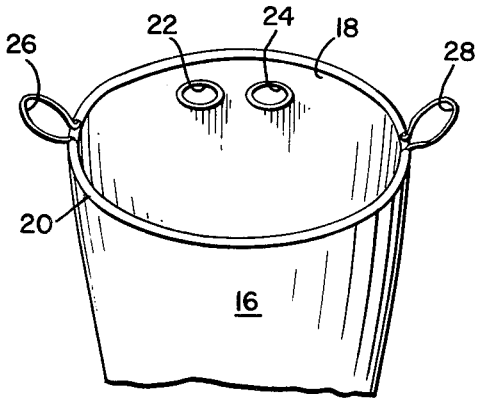
FIG. 4 is a partial perspective view of a leaf collection bag specifically structured for use with the bag spreading hoop of the invention.
Figure 5:
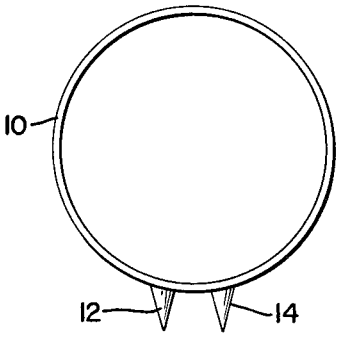
FIG. 5 is an elevation view of a bag spreading hoop.

If desired, a ramp or guiding chute 30 (FIG. 3) may be provided to further facilitate gathering of leaves into the bag. Ramp 30 may be made of suitable material such as stamped sheet metal or molded plastic and includes a forward, straight edge 32 which lies on the ground. The main body 34 of ramp 30 slopes and is tapered rearwardly into a semicircular configuration, ending in a curved, peripheral flange 36 for snap-fitting ramp 30 within hoop 10. Ramp 30 may be of relatively stiff but readily flexible sheet material. Ramp 30 is inserted into hoop 10 merely by pressing in opposed sides 38, 40 and then locking flange 36 into hoop 10. To remove ramp 30, sides 38, 40 are again pressed towards each other whereupon the ramp 30 may be lifted up to disengage flange 35 and then be withdrawn from hoop 10.

Of course, in the event ramp 30 is made of material which may be broken such as plastic, then it is initially inserted into hoop 10 only after hoop 10 has been oriented upright in the earth by placing one's foot over spikes 12, 14 and pressing the same into the ground, as explained above. In this way, the ramp will not be fractured. In any event, ramp 30 is not always needed but will be of assistance in some cases in gathering debris into the bag.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A spreader for temporarily holding open the mouth of a flexible bag so as to facilitate the gathering of leaves or other debris into the bag comprising: a relatively rigid, closed circle hoop stiff enough to be shape retaining about which the opened mouth of a bag may be placed; and ground penetration means affixed to said hoop and extending laterally, outwardly therefrom, whereby said hoop may be oriented upright with respect to the ground and said ground engaging means forced into the ground to stabilize said hoop and hold the open bag in a desired orientation during introduction of said debris.

2. The bag spreader claimed in claim 1 wherein said ground engaging means comprise a pair of spikes, arranged closely together whereby said spikes may be easily driven into the ground by a force applied to the inside of said hoop, above said spikes, against the earth.

3. The bag spreader claimed in claim 1 further comprising in combination a flexible bag having an open mouth and means provided at the periphery of said bag mouth for drawing said mouth closed.

4. The bag spreader claimed in claim 3 wherein said ground engaging means comprise a pair of spikes arranged closely together and said bag further comprises means defining sidewall openings therethrough adjacent said mouth for insertion of said spikes therethrough.

5. A spreader for temporarily holding open the mouth of a flexible bag so as to facilitate the gathering of leaves or other debris into the bag comprising: a relatively rigid closed circle hoop stiff enough to be shape retaining about which the opened mouth of a bag may be placed; ground penetration means affixed to said hoop and extending laterally, outwardly therefrom, whereby said hoop may be oriented upright with respect to the ground and said ground engaging means forced into the ground to stabilize said hoop and hold the open bag in a desired orientation during introduction of said debris; and a ramp having a leading edge arranged to contact the ground and a curved, rear edge lying over a portion of the inner periphery of said hoop, for guiding leaves or debris into the bag.

6. The bag spreader claimed in claim 5 wherein said ramp rear edge further includes means for securing said ramp on said hoop.

7. The bag spreader claimed in claim 5 wherein said hoop consists of an arcuate integral synthetic plastic element formed at one region of its periphery with one or more generally radially outwardly extending ground engaging anchoring projections.

* * * * *